United States Patent [19]

Sedlacek

[11] 4,050,581

[45] Sept. 27, 1977

[54] LUNCH BUCKET AND BEVERAGE BOTTLE COMBINATION

[76] Inventor: Raymond Sedlacek, 354 N. K St., Lakeview, Oreg. 97630

[21] Appl. No.: 695,182

[22] Filed: June 11, 1976

[51] Int. Cl.[2] ..... B65D 43/16; A45C 11/20

[52] U.S. Cl. ..... 206/544; 220/20

[58] Field of Search ..... 206/541, 549; 220/20, 220/8

[56] References Cited

U.S. PATENT DOCUMENTS 2,960,216 11/1960 Brady ..... 206/544

*Primary Examiner*—George T. Hall

*Attorney, Agent, or Firm*—John A. Hamilton

[57] ABSTRACT

A lunch bucket having a food compartment and a separate, unconnected compartment for a beverage bottle, so that liquid possibly leaking from the bottle cannot damage the food, both compartments having closure doors, the bottle compartment door operating a friction device operable to secure said door frictionally in either its open or its closed position, and to secure the bottle in position when said door is closed.

5 Claims, 5 Drawing Figures

LUNCH BUCKET AND BEVERAGE BOTTLE COMBINATION

This invention relates to new and useful improvements in lunch buckets, and has particular reference to lunch buckets including "Thermos" or other beverage bottles as standard elements thereof.

Lunch buckets including beverage containers or bottles have long been subject to certain malfunctions and disadvantages. If the beverage bottle is carried in the same compartment of the bucket as other food, then possible and all too frequent leakage of the bottle may allow the leaking liquid to damage or ruin the dry food. This is especially frequent when the beverage bottle is disposed in the top or cover portion of the bucket. Mounting of the bottle in the top portion of the bucket also renders the bucket somewhat topheavy and unstable when resting normally on its bottom, and its inclusion in the same bucket compartment as the other food of the lunch renders possible damage to the other food by the relatively heavy bottle comparatively common during usage.

Accordingly, the principal objects of the present invention are the provision of a lunch bucket and beverage bottle combination which overcomes and obviates all of the above enumerated malfunctions and disadvantages of prior devices, in that the beverage bottle is normally carried in a compartment of the bucket which is completely separate from the food compartment, so that any possible leakage of liquid from the bottle cannot damage the food, the bottle being carried in the bottom of the bucket to improve the stability of the latter, and the bottle compartment having a separate compartment opening through a side of the bucket different from that through which the food compartment opens, whereby to reduce the possibility that the heavy bottle could be dropped into or spilled into the food compartment.

Another object is the provision of a combination of the character described wherein the bottle compartment is provided with a hinged cover, and a friction device operable by said cover both to secure the bottle firmly in place when the cover is closed, and also to secure the cover releasably in either its closed or open positions.

Other objects are efficient usage of bucket space, simplicity and economy of construction, and efficiency and dependability of operation.

Figure 1:
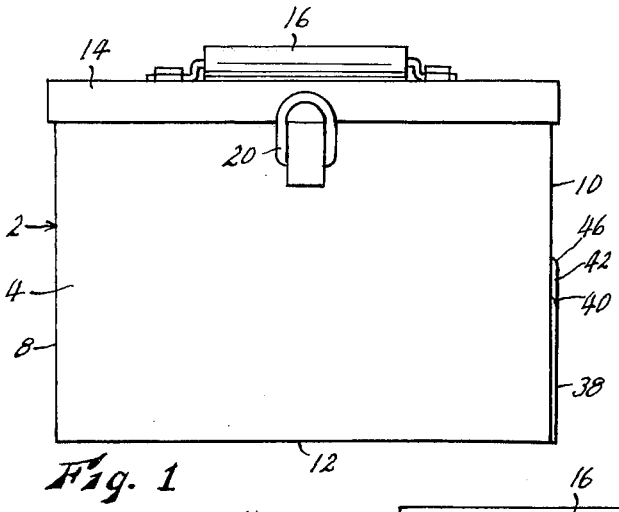
Figure 2:
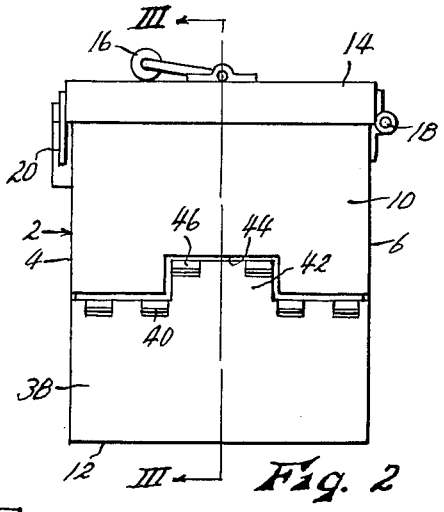
Figure 3:
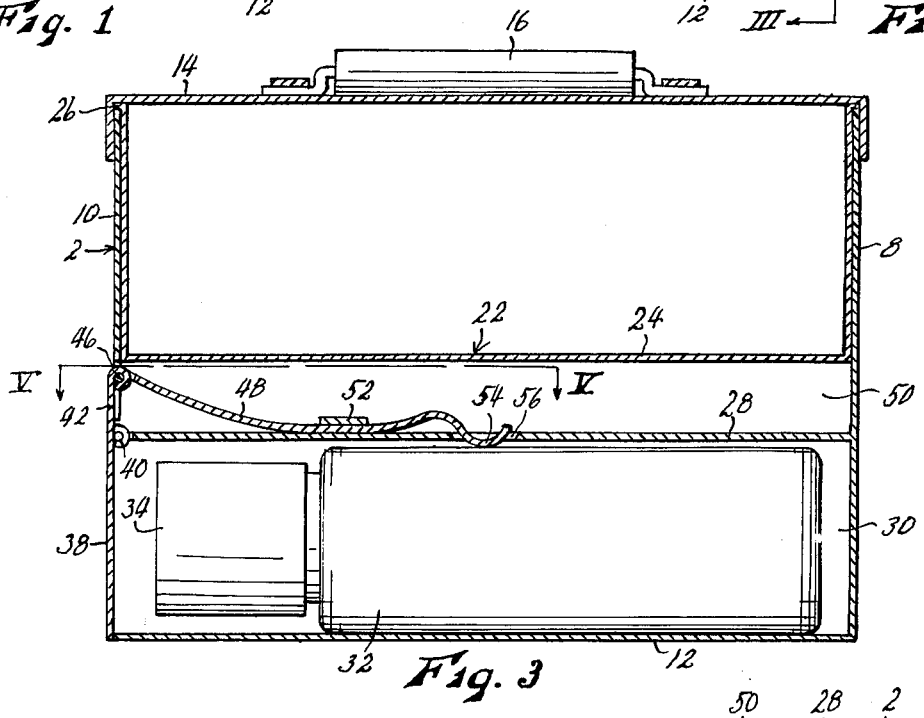
Figure 4:
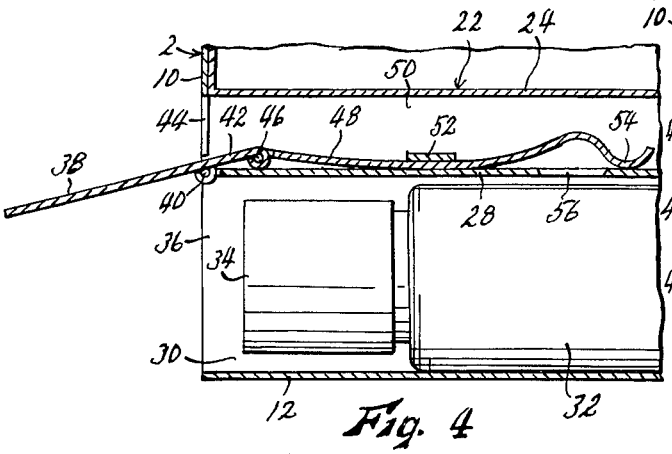
Figure 5:
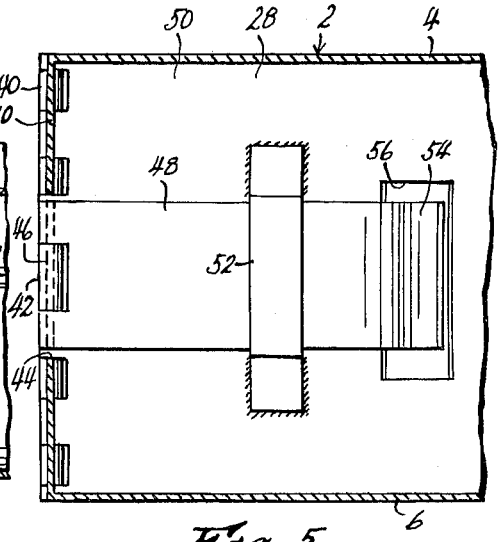

With these objects in view, as well as other objects which will appear in the course of the specification, reference will be had to the accompanying drawing, wherein:

FIG. 1 is a front elevational view of a lunch bucket and beverage bottle combination embodying the present invention, FIG. 2 is a side elevational view thereof, FIG. 3 is an enlarged sectional view taken on line III—III of FIG. 2, FIG. 4 is a fragmentary view similar to FIG. 3, showing the cover of the bottle compartment in its open position, and FIG. 5 is a fragmentary sectional view taken on line V—V of FIG. 3.

Like reference numerals apply to similar parts throughout the several views, and the numeral 2 applies generally to the lunch bucket itself, said lunch bucket being formed of sheet metal or other suitable material, and being of rectilinear form, having a front wall 4, rear wall 6, side walls 8 and 10, and floor 12. It is provided with a rectangular cover 14 having a carrying handle 16 attached thereto, said cover being attached to rear wall 6 of the bucket by hinge 18, and secured to front wall 4 by a releasable fastener 20 of any suitable type, the details thereof not being pertinent to the present invention and not being shown. Carried in the upper portion of the bucket is a food tray 22, also rectilinear in form, having a floor 24 and being open at its top. Horizontally, it fits snugly but slidably within bucket 2, and is provided at its top edge with an out-turned lip 26 which rests on the upper edges of the front, rear and side walls of the bucket, beneath cover 14. Thus, said tray is held firmly in position by closure of the cover, but may be lifted free of the bucket whenever the cover is open. Tray floor 24 is spaced well above bucket floor 12, and is parallel thereto. An intermediate horizontal wall 28 is fixed in the bucket, between and parallel to floors 12 and 24. The compartment 30 between floor 12 and wall 28 is adapted to receive a beverage bottle 32 therein. Said bottle has a removable cap 34, and is preferably of an insulated or vacuum type, such as a "Thermos" bottle, in order better to preserve the temperature of the beverage contained therein. Compartment 30 is of course rectangular in cross-sectional contour, and bottle 32 fits loosely therein, said bottle also preferably being of generally rectangular cross-sectional contour, or of "flask" shape, in order to make more efficient and complete usage of the volume of compartment 30.

Compartment 30 opens through side wall 10 of the bucket, said side wall terminating at its lower edge generally at the elevation of wall 28. The end opening 36 of compartment 30 thus provided is normally closed by a planar door 38, which is hinged, as at 40, to the free edge of wall 28, for pivotal movement from a closed position, as shown in FIGS. 1, 3 and 5, to, an open position as shown in FIG. 4. Midway of its width, door 38 is provided with an upward extension 42 which, when the door is closed, projects upwardly into a notch 44 formed in the lower edge of bucket side wall 10, substantially to the elevation of tray floor 24. At its upper end, extension 42 is hinged, as at 46, to one end of a leaf spring 48, which constitutes a friction device as will be described.

Leaf spring 48 extends generally horizontally into the space 50 between tray floor 24 and wall 28, projecting for longitudinal sliding movement beneath a keeper 52 welded to the upper surface of wall 28, being formed at its extreme opposite end to present a downwardly convex rounded protuberance 54 which, when door 38 is closed, extends downwardly through an opening 56 formed in wall 28 to bear resiliently and frictionally against the upper side of bottle 32, as best shown in FIG. 3. When door 38 is opened, it moves leaf spring 48 slidably beneath keeper 52 to move protuberance 54 out of registry with opening 56, so that said protuberance is cammed upwardly to rest on the upper surface of wall 28, as shown in FIG. 4.

Thus, in operation it will be seen that when door 38 is manually opened, it is held frictionally in its open position by the engagement of spring protuberance 54 with wall 28, as in FIG. 4, and beverage bottle 32 may be easily inserted into or removed from bucket compartment 30. When door 38 is manually closed, spring protuberance 54 is moved into registry with opening 56 of wall 28, and is urged resiliently therethrough by its spring bias to engage bottle 32 frictionally, as in FIG. 3. This engagement tends not only to secure the bottle firmly in place against accidental displacement from compartment 30, but also to secure door 38 firmly closed. In fact, in the event rough handling of the bucket should tend to displace the bottle toward door 38, the reactive force of the tendency to shift reacts through spring 48 to urge door 38 still more tightly closed.

Thus it will be apparent that a lunch bucket and beverage bottle combination having several advantages has been produced. The food space provided by tray 22, and bottle compartment 30, are completely separated and unconnected internally of the bucket, with the result that any possible liquid leakage from the bottle cannot soak or damage the food in tray 22. In this connection, it should be noted that while tray 22 is shown as removable from the bucket, as is preferred for reasons of convenience, the tray floor 24 could be permanently mounted in the bucket, with the front, rear and side walls of the food compartment being formed by the bucket walls themselves. This would provide a still more efficient and positive prevention of any liquid leaking from the bottle reaching the food. Also, since the food and bottle compartments of the bucket open through separate surfaces of the bucket, facing in different directions, there is far less likelihood that any beverage will be accidentally spilled on the food during loading or removal of food and beverage to and from the bucket. The friction device formed by leaf spring 48 both holds bottle compartment door 38 open or closed as desired, and also secures the bottle itself against accidental dislodgment from its compartment, and prevents rattling of the bottle.

While I have shown and described a specific embodiment of my invention, it will be readily apparent that many minor changes of structure and operation could be made without departing from the spirit of the invention.

What I claim as new and desire to protect by Letters Patent is:

1. A lunch bucket and beverage bottle combination comprising:

a. a lunch bucket having internal members dividing the interior thereof into a food compartment and a bottle compartment, said compartments being separate and unconnected with each other, sealed from each other internally of said bucket, and having separate, spaced apart openings outwardly from said bucket, b. a beverage bottle carried removably in said bottle compartment, the separate relation of said compartment preventing any possibility of liquid leaking from said bottle reaching said food compartment, c. a friction device operable when engaged to resist movement of said bottle from said bottle compartment through the outward opening of said compartment, and d. operating means carried by said bucket and operable selectively to engage or disengage said friction device.

2. The combination as recited in claim 1 wherein said operating means comprises a door carried by said bucket for movement between a closed position in which it closes the outward opening of said bottle compartment, and an open position in which it does not obstruct said outward opening, said door being operable to engage said friction device when it is closed, and to disengage said friction device when it is opened.

3. The combination as recited in claim 2 wherein said friction device is additionally operable to restrain said door frictionally in both its open position and in its closed position.

4. The combination as recited in claim 2 wherein said door is hinged to said bucket on an axis transverse to the direction of movement of said bottle as it is inserted into or removed from said bottle compartment, and wherein said friction device comprises an elongated leaf spring extending along a fixed bucket wall constituting a wall of said bottle compartment parallel to said direction of bottle movement, said spring being slidably connected intermediate its ends to said fixed bucket wall exteriorly to said bottle compartment, one end of said spring being hinged to said door on an axis parallel but eccentric to said door hinge, whereby said spring is moved longitudinally responsively to opening or closing of said door, and the opposite end of said spring being formed to present a protuberance which, when the door is closed, projects through an opening of said fixed bucket wall to engage a bottle in said bottle compartment, but which is moved out of registry with said wall opening when said door is opened, said spring being biased to press said protuberance against said bottle with substantial pressure, and said protuberance being rounded to be cammed out of said wall opening by said wall as said protuberance is moved out of registry with said opening.

5. The combination as recited in claim 4 wherein said spring protuberance moves out of registry with said fixed wall opening in a direction away from the outward opening of said bottle compartment as said door is opened, whereby when said door is closed and said protuberance engages said bottle, any tendancy of the bottle to move toward said door reacts longitudinally through said spring to force said door more tightly closed.

* * * * *